US010903551B2

(12) United States Patent
Huang et al.

(10) Patent No.: US 10,903,551 B2
(45) Date of Patent: Jan. 26, 2021

(54) ANTENNA DEVICE

(71) Applicant: PEGATRON CORPORATION, Taipei (TW)

(72) Inventors: Chin-Ting Huang, Taipei (TW); Yan-Hua Chen, Taipei (TW); Sony Chayadi, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 140 days.

(21) Appl. No.: 16/361,381

(22) Filed: Mar. 22, 2019

(65) Prior Publication Data

US 2019/0296422 A1 Sep. 26, 2019

(30) Foreign Application Priority Data

Mar. 26, 2018 (TW) ..... 107110338 A

(51) Int. Cl.

| | |
|---|---|
| ***H01Q 1/24*** | (2006.01) |
| ***H01Q 1/00*** | (2006.01) |
| ***H01Q 5/35*** | (2015.01) |
| ***H01Q 1/48*** | (2006.01) |

(52) U.S. Cl.

CPC ..... *H01Q 1/246* (2013.01); *H01Q 1/007* (2013.01); *H01Q 1/48* (2013.01); *H01Q 5/35* (2015.01)

(58) Field of Classification Search

CPC .. H01Q 1/24; H01Q 5/35; H01Q 1/00; H01Q 1/48

USPC ..... 343/848

See application file for complete search history.

(56) References Cited

U.S. PATENT DOCUMENTS 6,624,790 B1 9/2003 Wong et al.
2008/0258992 A1* 10/2008 Tsai ..... H01Q 1/2266 343/853

* cited by examiner

*Primary Examiner* — Andrea Lindgren Baltzell
(74) *Attorney, Agent, or Firm* — McClure, Qualey & Rodack, LLP

(57) ABSTRACT

An antenna device includes a first ground plane, a second ground plane, a first antenna unit, a second antenna unit, and a metal plate. The second ground plane is connected to the first ground plane. The first antenna unit is disposed on the second ground plane. The second antenna unit is disposed on the second ground plane. The metal plate and is connected to the second ground plane and the location of the metal plate is arranged corresponding to the first antenna unit and the second antenna unit. Each of the first antenna unit and the second antenna unit is configured to cooperate with the first ground plane and the metal plate to generate a radiation pattern perpendicular to the first ground plane.

11 Claims, 7 Drawing Sheets

ANTENNA DEVICE

CROSS-REFERENCE TO RELATED APPLICATIONS

This Non-provisional application claims priority under 35 U.S.C. § 119(a) on Taiwan Application Serial Number 107110338, filed Mar. 26, 2018, which is herein incorporated by reference.

BACKGROUND

Technology Field

The present invention relates to an antenna device. More particularly, the present invention relates to an antenna device that can generate omnidirectional radiation pattern.

Description of Related Art

As the time of the Internet of things (IoT) has come, one can say that the wireless access point is the most convenient option to connect IoT devices to the internet. In pursuit of a router that can completely covered by wireless network and possesses no dead zone, it is required that the wireless router conducts wireless communication through wireless network, the wireless access point on the ceiling, and neighboring users.

However, since the user and the wireless access point are at different places, it could be very easy for the antennas of the router to be damaged or cause displeasure to the eye due to the mass amount of space they would take up if they are disposed in every direction.

Therefore, how to design an antenna device that can generate omnidirectional radiation pattern so as to cover the wireless access point on the ceiling as well as the neighboring user is a technical problem in the field of the art that needs to be improved.

SUMMARY

The following presents a simplified summary of the disclosure in order to provide a basic understanding to the reader. This summary is not an extensive overview of the disclosure and it does not identify key/critical elements of the present invention or delineate the scope of the present invention.

One embodiment of this disclosure provides an antenna device. The antenna device includes a first ground plane, a second ground plane, a first antenna unit, a second antenna unit, and a metal plate. The second ground plane is connected to the first ground plane. The first antenna unit is disposed on the second ground plane. The second antenna unit is disposed on the second ground plane. The metal plate is connected to the second plane, and is disposed on a position corresponding to the first antenna unit and the second antenna unit. Each of the first antenna unit and the second antenna unit is able to cooperate with the first ground plane and the metal plate respectively to generate radiation pattern which is perpendicular to the first ground plane.

From the embodiments mentioned above, it can be known that the embodiments of this disclosure enable two antenna units to generate a radiation pattern that radiates towards the ceiling to conduct wireless communication with wireless access point by disposing two antenna units whose open ends are disposed correspondingly to each other and a specially shaped metal plate on the same side.

BRIEF DESCRIPTION OF THE DRAWINGS

The invention can be more fully understood by reading the following detailed description of the embodiment, with reference made to the accompanying drawings as follows.

Figure 1:
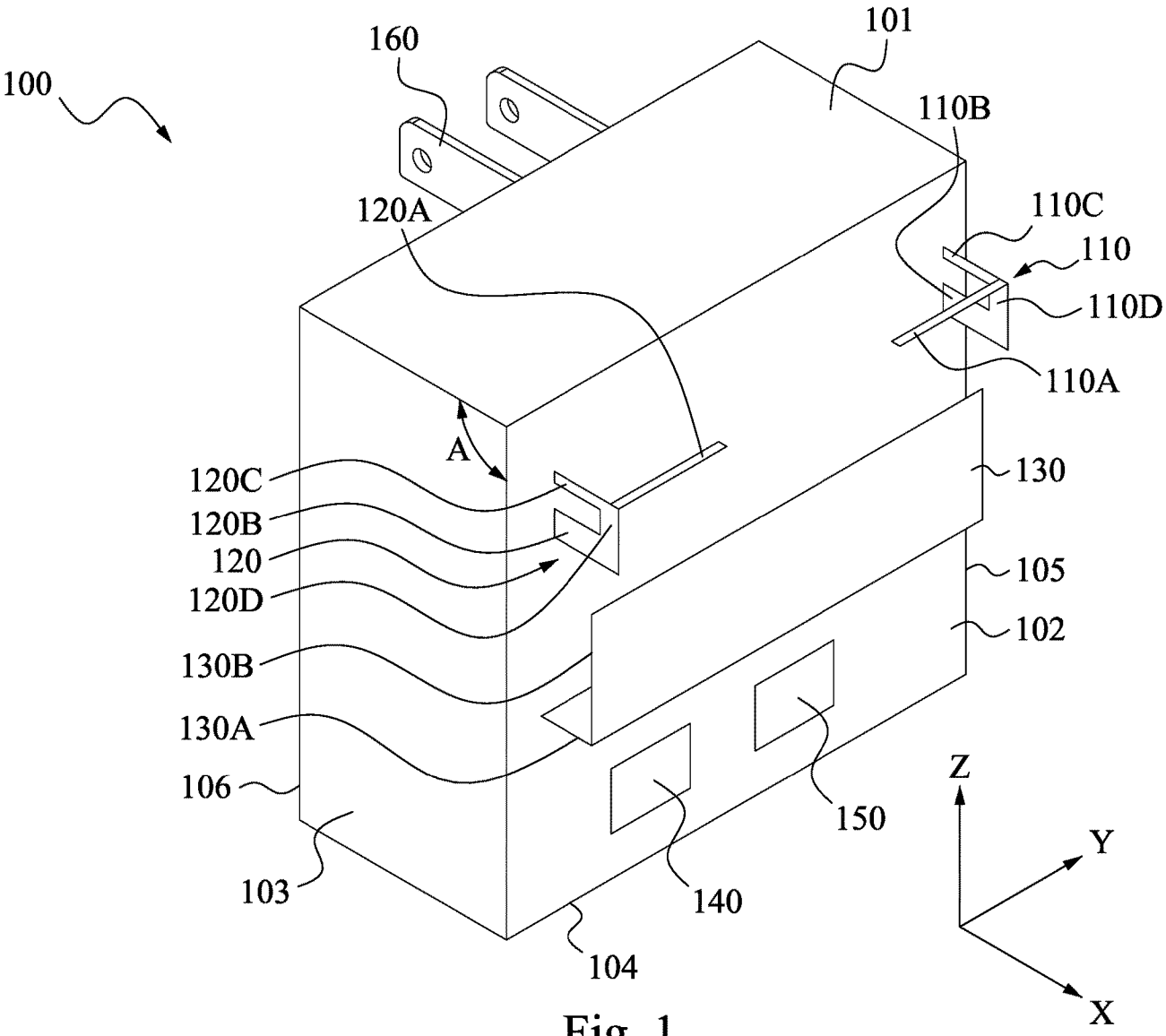
FIG. 1 illustrates a 3-dimensional schematic diagram of an antenna device in accordance with some embodiments of the present disclosure.

In accordance with common practice, the various described features/elements are not drawn to scale but instead are drawn to best illustrate specific features/elements relevant to the present invention. Also, wherever possible, like or the same reference numerals are used in the drawings and the description to refer to the same or like parts.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Unless otherwise defined herein, scientific and technical terminologies employed in the present disclosure shall have the meanings that are commonly understood and used by one of ordinary skill in the art. Unless otherwise required by context, it is understood that singular terms shall include plural forms of the same and plural terms shall include singular forms of the same.

The objective of this disclosure is to disclose an antenna device that is capable of generating a radiation pattern that is wide and has no dent. The antenna device has no dead zone, a peak gain lower than 6 dBi, and makes the isolation between the antennas units lower than the standard value of 20 dB.

FIG. 1 illustrates a 3D schematic diagram of an antenna device 100 in accordance with some embodiments of this disclosure. Reference is now made to FIG. 1, in some embodiments, the antenna device 100 includes a ground plane 101, a ground plane 102, an antenna unit 110, an antenna unit 120, and a metal plate 130, wherein the ground plane 101 is connected to the ground plane 102, and the antenna unit 110 and the antenna unit 120 are disposed on the ground plane 102 respectively. The metal plate 130 is connected to the ground plane 102 and is disposed in a position corresponding to the antenna unit 110 and the antenna unit 120. In detail, the metal plate 130 is disposed near the +x direction and −z direction relative to the antenna unit 110 and the antenna unit 120, and is not connected to the antenna unit 110 and the antenna unit 120.

In some embodiments, there is an included angle A between the ground plane 101 and the ground plane 102. The included angle A is but not limited to 90 degrees, an included angle with any degree is in the scope of this disclosure.

In some embodiments, the ground plane 101 and the ground plane 102 are used as the ground planes of the antenna unit 110 and the antenna unit 120, and are used respectively as the adjustment plate of the radiation pattern of the antenna unit 110 and the antenna unit 120.

In some embodiments, the antenna unit 110 and the antenna unit 120 are used to cooperate with the ground plane 101 and the metal plate 130 to generate a radiation that is perpendicular to the ground plane 101 (which is the same as the +z direction shown in FIG. 1). Specifically, take the antenna unit 110 for example, the electromagnetic wave generated by the antenna unit 110 will be reflected by the ground plane 101 and the metal plate 130 to generate a radiation pattern that propagates in the +z direction. In practical application, the antenna unit 110 and the antenna unit 120 are used to conduct wireless communication with the wireless access point (WAP) above the antenna device 100, so that the antenna device 100 can connect to the internet through the wireless access point.

In some embodiments, the antenna 110 and the antenna unit 120 are single band antennas and are operated at the same frequency, for instance, the antenna unit 110 and the antenna unit 120 are both operated at the frequency of 2.44 GHz to serve as a Wi-Fi antenna. The frequency mentioned herein is not intended to be limitation of the antenna unit 110 and the antenna unit 120, any operating frequency is in the scope of this disclosure.

In some embodiments, the antenna unit 110 and the antenna unit 120 may be implemented by a Planar Inverted F Antenna (PIFA), dipole antenna, and loop antenna. The types of antenna mentioned herein is not intended to be limitations of the antenna unit 110 and the antenna unit 120, any electrical element that is applicable to implement the antenna unit 110 and the antenna unit 120 are in the scope of this disclosure.

In some embodiments, the antenna unit 110 includes an open end 110A, a ground terminal 1108, a signal input terminal 110C, and a connection portion 110D, wherein the connection portion 110D is connected to the ground terminal 1108 and the signal input terminal 110C, the ground terminal 1108 of the antenna unit 110 is coupled to ground via the ground plane 102, and the input signal terminal 110C of the antenna unit 110 is coupled to a signal source (not illustrated) to receive electrical signals from the signal source (not illustrated). In some embodiments, the antenna unit 120 includes an open end 120A, a ground terminal 120B, a signal input terminal 120C, and a connection portion 120D, wherein the connection portion 120D is connected to the ground terminal 120B and the signal input terminal 120C; the ground terminal 120B of the antenna unit 120 is coupled to ground via the ground plane 102; and the input signal terminal 120C of the antenna unit 120 is coupled to a signal source (not illustrated) to receive electrical signals from the signal source (not illustrated). In some embodiments, the open end 110A of the antenna unit 110 is disposed in correspondence with the open end 120A of the antenna unit 120.

In some embodiments, in order to keep a certain distance between the antenna unit 110 and the antenna unit 120 as well as avoid increasing the volume of the antenna device 100, the angle between the connection portion 110D and the open end 110A of the antenna unit 110 is arranged to be 90 degree, and the angle between the connection portion 120D and the open end 120A of the antenna unit 120 is arranged to be 90 degree. With the arrangement mentioned above, the distance between the antenna unit 110 and the antenna unit 120 along the y axis is made longer, which improves the isolation between the antenna unit 110 and the antenna unit 120. In some embodiments, the minimum distance between the antenna unit 110 and the antenna unit 120 is, but not limited to, 3 centimeters, and any suitable distance between the antenna unit 110 and the antenna unit 120 is within the scope of this disclosure.

In some embodiments, the distance between the antenna unit 110 and the metal plate 130 and the distance between the antenna unit 120 and the metal plate 130 both are, but not limited to, 1 centimeter, and any suitable distance that enables each of the antenna unit 110 and the antenna unit 120 to generate an omnidirectional radiation pattern that has no dent is within the scope of this disclosure.

In some embodiments, the metal plate 130 is configured to be the plate for the radiation pattern adjustment for both the antenna unit 110 and the antenna unit 120, so as to enable each of the antenna unit 110 and the antenna unit 120 to generate radiation pattern without dent. In some embodiments, an isolation is lower than −20 dB after adding the metal plate 130 to the antenna device 100. The reason is that because the antenna unit 110 will generate an induced current after it receives an electrical signal from a signal source (not illustrated), the induced current will flow through the metal plate 130 when the metal plate 130 and the antenna unit 110 are disposed close to each other, so the radiation pattern generated by antenna unit 120 won't be affected.

In some embodiments, as shown in FIG. 1, the metal plate 130 is in L shape. Specifically, the metal plate 130 includes a metal surface 130A and a metal surface 130B. The metal surface 130A is connected to the ground plane 102 and is disposed perpendicularly to the ground plane 102. The metal surface 130A extends in the opposite direction away from the ground plane 102 (i.e. the +x direction). The metal plane 130B is connected to the metal surface 130A, and is disposed perpendicularly to the ground plane 130A. The metal surface 130B extends from the metal surface 130A in the direction towards the ground plane 101 (i.e. the +z direction).

In some embodiments, the sum of the length of the metal surface 130A along the x axis and the length of the metal surface 130B along the z axis (i.e. the length of the L shape) is a quarter of the wavelength, wherein the wavelength corresponds to the operating frequency of the antenna unit 110 and the antenna unit 120. For example, if the operating frequency of the antenna unit 110 and the antenna unit 120 is 2.44 GHz, the length of the L shape formed by the metal plate 130 is approximately 3 centimeters.

As shown in FIG. 1, in some embodiments, the antenna device 100 further includes an antenna unit 140 and an antenna unit 150. Each of the antenna unit 140 and the antenna unit 150 is disposed on the ground plane 102.

In some embodiments, the antenna unit 140 and the antenna unit 150 are configured to generate a radiation pattern that is perpendicular to the ground plane 102 (i.e. along the x axis), so that the antenna device 100 conducts wireless communication with neighboring users through the antenna unit 140 and the antenna unit 150. In some embodiments of this disclosure, the antenna device 100 includes only two antenna units (i.e. the antenna unit 140 and the antenna unit 150) to conduct wireless communication with neighboring users; however, the number of the antenna included by the antenna device is not limited thereto, any suitable number of the antenna unit included by the antenna device is within the scope of this disclosure.

In some embodiments, the reason for disposing the antenna units 110, 120, 140, and 150 on the same plane (i.e. the ground plane 102) is to lower the volume of the antenna device 100, so as to achieve a better use of space. In comparison, if the antenna unit 110 and the antenna unit 120 are disposed on the ground plane 101, and the antenna unit 140 and the antenna unit 150 are disposed on the ground plane 102, the antenna device 100 will undoubtedly obtain a better radiation pattern; however, the volume of the antenna device 100 will increase as well.

As shown in FIG. 1, in some embodiments, the antenna device 100 further includes ground planes 103, 104, 105, and 106, so as to form a metal box that is enclosed by the ground planes 101-106. The antenna device includes six planes that form the metal box so that the RF circuit, the central processing unit, the memory, and the baseband circuit can be disposed in this metal box. As a result, interferences to the antenna unit 110 and the antenna unit 120 can be avoided while we are pursuing a better look of the antenna device.

In some embodiments, the material of the ground planes 101-106 and the metal plate 130 can be metal component, carbon fiber component, or other components made of conductive materials.

As shown in FIG. 1, in some embodiments, the antenna device 100 further includes a plug 160. The plug 160 is disposed on the ground plane 106, so the plug 160 can be plugged into the plug socket on the wall, so as to provide electrical power to the antenna device 100.

Figure 2:
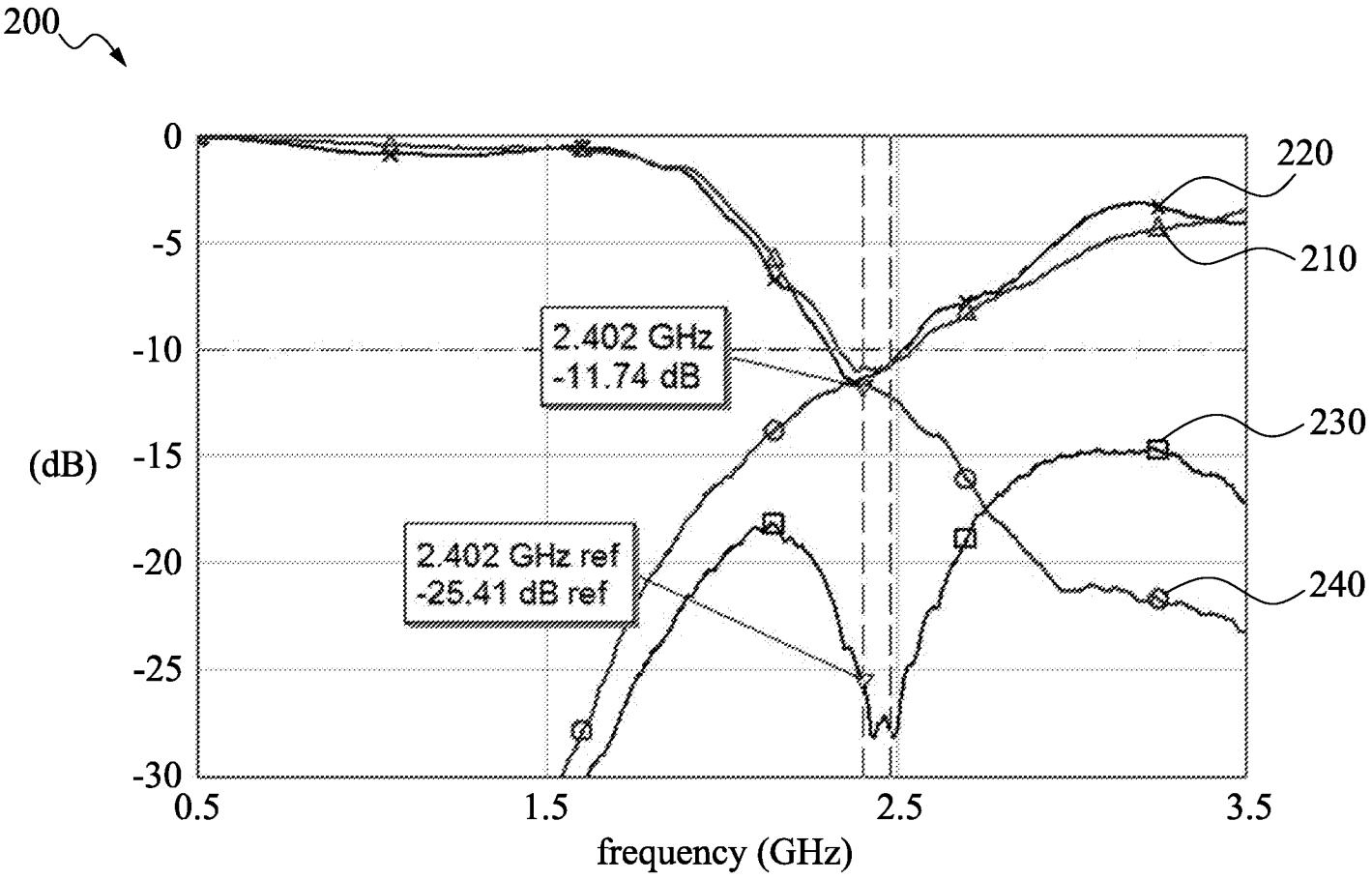
FIG. 2 illustrates a data graph of an antenna device in accordance with some embodiments of the present disclosure.

FIG. 2 illustrates a data graph of an antenna device in accordance with some embodiments of the present disclosure. FIG. 2 is an experimental data graph 200 showing the relationship between frequency and reflection loss S11 and the relationship between frequency and isolation S21. The input impedance adopts a standard of VSWR=1.9:1 (VSWR stands for voltage standing wave ratio) or reflection loss S11=−10 dB. The curve 210 is the reflection loss S11 of the antenna unit 120. The curve 220 is the reflection loss S11 of the antenna unit 110. The curve 230 is the isolation S21 between the antenna unit 110 and the antenna unit 120 under the condition that the antenna device 100 adopts the L-shaped metal plate 130. The curve 240 is the isolation S21 between the antenna unit 110 and the antenna unit 120 under the condition that the antenna device 100 does not adopt the L-shaped metal plate 130.

As can be seen from the data graph 200, when the antenna device is operating at frequencies of approximately 2440 MHz, the reflection loss of the antenna unit 110 and the reflection loss of the antenna unit 120 reach their minimum values (about −12 dB). As can be seen from the data graph 200, when the L-shaped metal plate 130 is disposed in the antenna device 100, the isolation S21 of the antenna device 100 will improve comprehensibly (as shown in FIG. 2, the isolation of the antenna device decreases from −12 dB to −25 dB at the frequency of 2.4 GHz).

Figure 3:
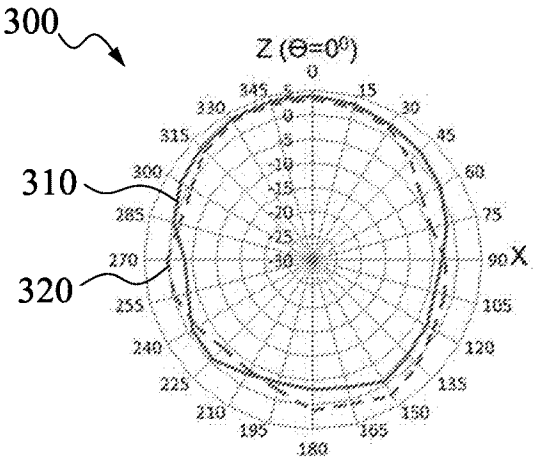
FIG. 3 illustrates a H-plane radiation pattern of an antenna unit in accordance with some embodiments of the present disclosure.

FIG. 3 illustrates the H plane radiation pattern 300 of an antenna unit 120 in accordance with some embodiments of this disclosure. FIG. 3 represents the radiation pattern 300 generated by the antenna unit 120 of FIG. 1 at the frequency of 2.44 GHz on the H-plane. The curve 320 represents the gain of the electrical field Eθ+Eϕ generated by the antenna unit 120 on the XZ plane under the condition that the antenna device 100 does not adopt the L-shaped metal plate 130. The curve 310 represents the gain of the electrical field Eθ+Eϕ generated by the antenna unit 120 on the XZ plane under the condition that the antenna device 100 adopts the L-shaped metal plate 130. As can be seen from FIG. 3, the radiation pattern generated by the antenna unit 120 will have obvious dents at the angles of 60° and 300° if the antenna device 100 does not adopt the L-shaped metal plate 130. If the antenna device 100 adopts the metal plate 130, the dents in the radiation pattern can be effectively improved, and better electrical field gain can be obtained at every angle. In other words, through the implementation of the L-shaped metal plate 130 in the antenna device 100 presented in this disclosure, the radiation pattern generated by the antenna unit 120 can be largely improved at the angle of 60° and at the angle of 300°.

Figure 4:
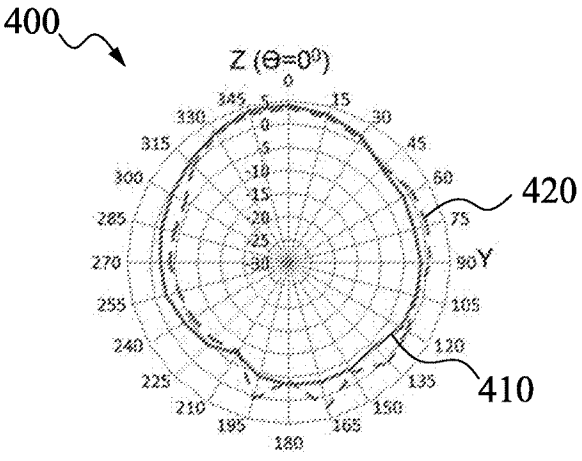
FIG. 4 illustrates a E-plane radiation pattern of an antenna unit in accordance with some embodiments of the present disclosure.

FIG. 4 illustrates the radiation pattern 400 generated by the antenna unit 120 on the E-plane in accordance with some embodiments of this disclosure. FIG. 4 represents the radiation pattern 400 generated by antenna unit 120 of FIG. 1 at the frequency of 2.44 GHz on the E-plane. The curve 420 represents the gain of the electrical field Eθ+Eϕ generated by the antenna unit 120 on the YZ plane under the condition that the antenna device 100 does not adopt the L-shaped metal plate 130. The curve 410 represents the gain of the electrical field Eθ+Eϕ generated by the antenna unit 120 on the YZ plane under the condition that the antenna device 100 adopts the L-shaped metal plate 130. As can be seen from FIG. 4, the radiation pattern generated by the antenna unit 120 will have obvious dent at the angle of 300° if the antenna device 100 does not adopt the L-shaped metal plate 130. If the antenna device 100 adopts the metal plate 130, the dent in the radiation pattern can be effectively improved, and better electrical field strength can be obtained at every angle. In other words, through the implementation of the L-shaped metal plate 130 in the antenna device 100 presented in this disclosure, the radiation pattern generated by the antenna unit 120 can be largely improved at the angle at the angle of 300°.

On the other hand, as can be seen from the result of the measurement of the 3D radiation pattern, when the antenna unit 120 is operating at the frequency of 2.44 GHz, the maximum value of the gain of the antenna unit 120 is 4.1 dB, and the antenna efficiency is 75.5%.

Figure 5:
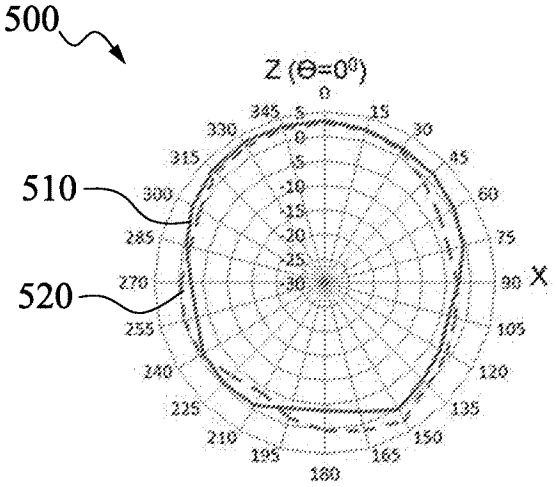
FIG. 5 illustrates a H-plane radiation pattern of an antenna unit in accordance with some embodiments of the present disclosure.

FIG. 5 illustrates the radiation pattern 500 generated by the antenna unit 110 on the H-plane in accordance with some embodiments of this disclosure. FIG. 5 represents the radiation pattern 500 generated by the antenna unit 110 of FIG. 1 at the frequency of 2.44 GHz on the H-plane. The curve 520 represents the gain of the electrical field Eθ+Eϕ generated by the antenna unit 120 on the XZ plane under the condition that the antenna device 100 does not adopt the L-shaped metal plate 130. The curve 510 represents the gain of the electrical field Eθ+Eϕ generated by the antenna unit 110 on the XZ plane under the condition that the antenna device 100 adopts the L-shaped metal plate 130. As can be seen from FIG. 5, the radiation pattern generated by the antenna unit 110 will have an obvious dent at the angle of 60° if the antenna device 100 does not adopt the L-shaped metal plate 130. If the antenna device 100 adopts the metal plate 130, the dent in the radiation pattern can be effectively improved, and better electrical field strength can be obtained at every angle. In other words, through the implementation of the L-shaped metal plate 130 in the antenna device 100 presented in this disclosure, the radiation pattern generated by the antenna unit 110 can be largely improved at the angle at the angle of 60°.

Figure 6:
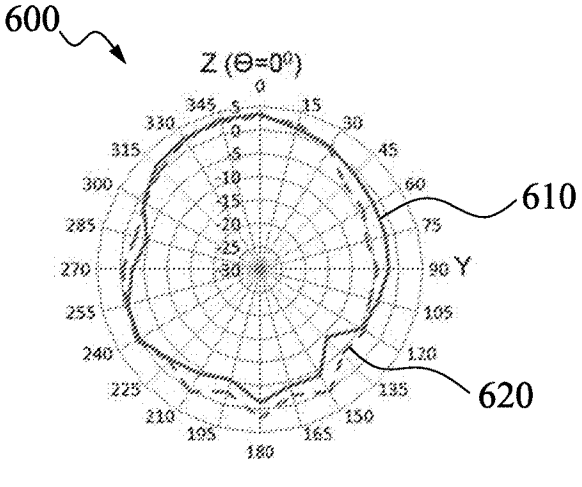
FIG. 6 illustrates a E-plane radiation pattern of an antenna unit in accordance with some embodiments of the present disclosure.

FIG. 6 illustrates the radiation pattern 600 generated by the antenna unit 110 on the E-plane in accordance with some embodiments of this disclosure. FIG. 6 represents the radiation pattern 600 generated by the antenna unit 110 of FIG. 1 at the frequency of 2.44 GHz on the E-plane. The curve 620 represents the gain of the electrical field Eθ+Eϕ generated by the antenna unit 110 on the YZ plane under the condition that the antenna device 100 does not adopt the L-shaped metal plate 130. The curve 610 represents the gain of the electrical field Eθ+Eϕ generated by the antenna unit 110 on the YZ plane under the condition that the antenna device 100 adopts the L-shaped metal plate 130. As can be seen from FIG. 6, the radiation pattern generated by the antenna unit 110 will have an obvious dent at the angle of 60° if the antenna device 100 does not adopt the L-shaped metal plate 130. If the antenna device 100 adopts the metal plate 130, the dent in the radiation pattern can be effectively improved, and better electrical field strength can be obtained at every angle. In other words, through the implementation of the L-shaped metal plate 730 in the antenna device 100 presented in this disclosure, the radiation pattern generated by the antenna unit 110 can be largely improved at the angle at the angle of 60°.

On the other hand, as can be seen from the result of the measurement of the 3D radiation pattern, when the antenna unit 120 is operating at the frequency of 2.44 GHz, the maximum value of the gain of the antenna unit 120 is 3.6 dB, and the antenna efficiency is 77.1%.

Figure 7:
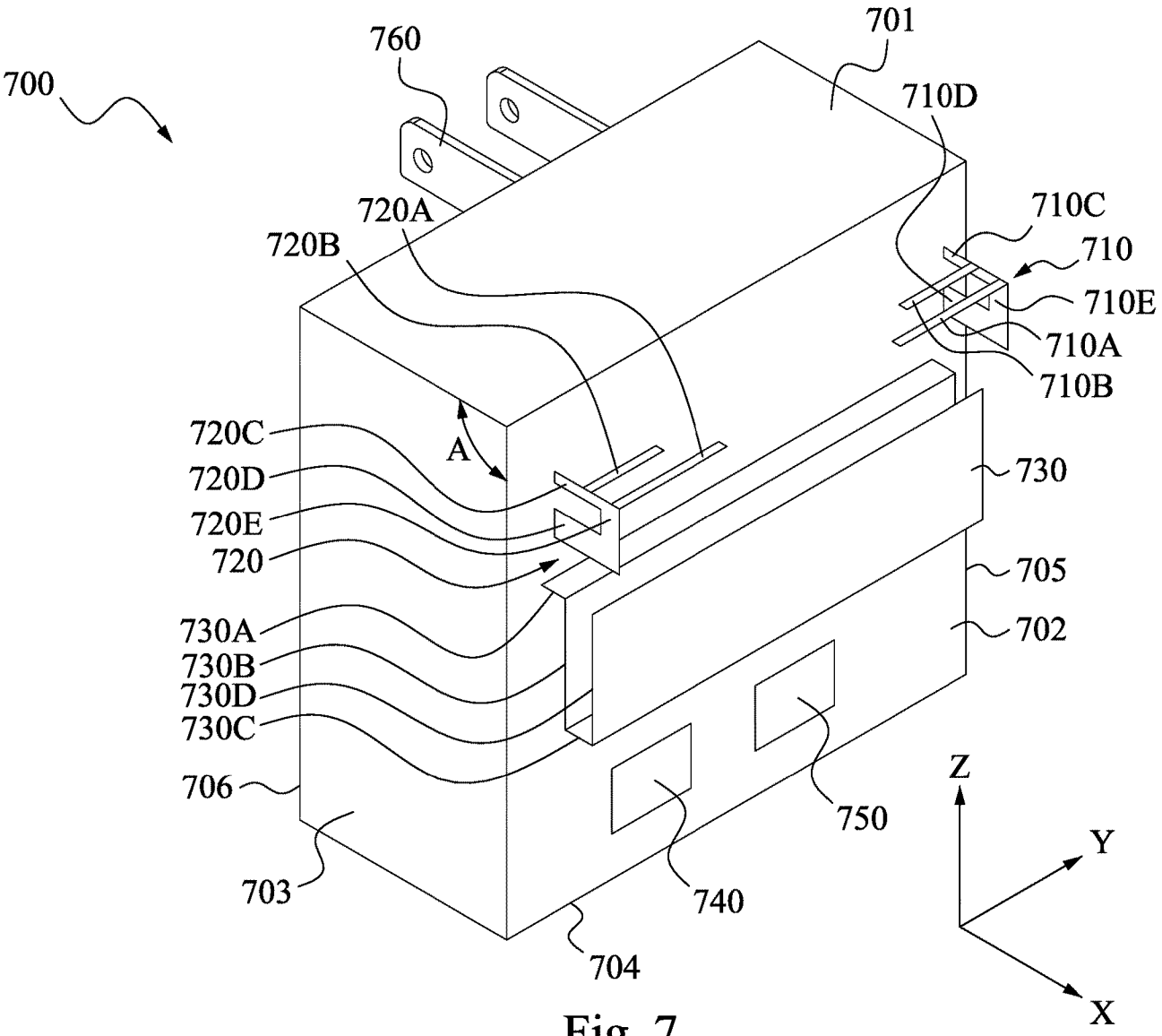
FIG. 7 illustrates a 3-dimensional schematic diagram of an antenna device in accordance with some embodiments of the present disclosure.

FIG. 7 illustrates a 3-dimensional schematic diagram of an antenna device 700 in accordance with some embodiments of this disclosure. In some embodiments, the function and the shape of the ground plane 701-706 of the antenna device 700 are the same as the ground plane 101-106 of the antenna device 100; the function and the shape of the antenna unit 740 and 750 of the antenna device 700 are the same as the antenna unit 140 and 150 of the antenna device 100; and the function and the shape of the plug 760 of the antenna device 700 are the same as the plug 160 of the antenna device 100. Aside from the components that are the same as their counterparts in the antenna device 100, the antenna device 700 further includes an antenna unit 710, an antenna unit 720, and a metal plate 730. The antenna unit 710 and the antenna unit 720 are connected to the ground plane 702. The metal plate 730 is connected to the ground plane 702, and is disposed perpendicularly to the ground plane 702. The metal plate 730 is disposed in correspondence with the antenna unit 710 and the antenna unit 720. Specifically, the metal plate 730 is disposed near the −Z direction of the antenna unit 710 and the antenna unit 720, and is not connected to the antenna unit 710 and the antenna unit 720.

In some embodiments, the antenna unit 710 and the antenna unit 720 are configured to generate a radiation pattern that is perpendicular to the ground plane 701 (i.e. in the +z direction shown in FIG. 7). Specifically, take the antenna unit 710 for example, electromagnetic wave generated by the antenna unit 710 will be reflected by the ground plane 701 and the metal plate 730 to generate a radiation pattern that propagates in the +z direction. In practical applications, the antenna unit 710 and the antenna unit 720 are configured to conduct wireless communication with the wireless access point that is located above the antenna device 700.

In some embodiments, the antenna unit 710 and the antenna unit 720 are dual-band antennas, i.e., the antenna unit 710 can be operated at a first frequency and a second frequency, and the antenna unit 720 can also be operated at the first frequency and the second frequency, for example, the first frequency can be 2.44 GHz, and the second frequency can be 5.5 GHz. But this disclosure is not limited to the first frequency and the second frequency mentioned above, any suitable operating frequency is within the scope of this disclosure.

In some embodiments, the antenna unit 710 and the antenna unit 720 can be implemented by planar inverted F antenna, dipole antenna and loop antenna. But this disclosure is not limited to the types of antenna mentioned above. Any antenna that that is suitable for implementing antenna unit 710 and antenna unit 720 is within the scope of this disclosure.

In some embodiments, antenna unit 710 includes an open end 710A, an open end 710B, a signal input terminal 710C, a ground terminal 710D, and a connection portion 710E. The connection portion 710E is connected to the ground terminal 710D and the signal input terminal 710C. The open end 710A of the antenna unit 710 and the signal input terminal 710C form an electrical path corresponding to the first frequency (e.g., 2.44 GHz). The open end 710B and the signal input terminal 710C form an electrical path corresponding to the second frequency (e.g., 5.5 GHz). The ground terminal 710D of the antenna unit 710 is coupled to the ground plane 702 to connect to the ground. The signal input terminal 710C of the antenna unit 710 is coupled to the signal source (not illustrated). In some embodiments, the antenna unit 720 includes an open end 720A, an open end 720B, a signal input terminal 720C, a ground terminal 720D, and a connection portion 720E. The connection portion 720E is connected to the ground terminal 720D and signal input terminal 720C. The open end 720A and the signal input terminal 720C of the antenna unit 720 form an electrical path corresponding to the first frequency (e.g. 2.44 GHz). The open end 720B and signal input terminal 720C form an electrical path, corresponding to the second frequency (e.g. 5.5 GHz). The ground terminal 720D of the antenna unit 720 is coupled to the ground plane 702 to connect to the ground. The signal input terminal 720C of the antenna unit 720 is coupled to the signal source (not illustrated).

In some embodiments, the open end 710A of the antenna unit 710 is disposed in correspondence with the open end 720A of the antenna unit 720, and the open end 710B of the antenna unit 710 is disposed in correspondence with the open end 720B of the antenna unit 720. In some embodiments, the connection portion 710E of the antenna unit 710 and the open end 710A of the antenna unit 710 are disposed perpendicularly to each other, and the connection portion 720E and the open end 720A of the antenna unit 720 are disposed perpendicularly to each other to keep the volume of the antenna device 700 unchanged and increase the distance between the antenna unit 710 and the antenna unit 720 as well, so as to obtain a better isolation between the antenna unit 710 and the antenna unit 720 (as illustrated in FIG. 1).

In some embodiments, the metal plate 730 is configured to make the antenna unit 710 and the antenna unit 720 generate radiation pattern that has no dent. In some embodiments, as shown in FIG. 7, the metal plate 730 is in U shape. Specifically, the metal plate 730 includes a metal plane 730A, a metal plane 730B, a metal plane 730C, and a metal plane 730D. The metal plane 730A is connected to the ground plane 702 and is disposed perpendicularly to the ground plane 702. The metal plane 730A extends in the opposite direction away from the ground plane 702 (i.e. the +x direction). The metal plane 730B is connected to the metal plane 730A and is disposed perpendicularly to the metal plane 730A. The metal plane 730B extends from the metal plate 730A in the opposite direction away from the ground plane 704 (i.e. the −z direction). The metal plane 730C is connected to the metal plane 730B and is disposed perpendicularly to the metal plane 730B. The metal plane 730C extends from the metal plane 730B in the opposite direction away from the ground plane 702 (i.e., the +x direction). The metal plane 730D is connected to the metal plane 730C and is disposed perpendicularly to the metal plane 730C. The metal plane 730D extends from the metal plane 730C towards the ground plane 701 (i.e., the +z direction).

In some embodiments, the sum of the length of the metal plane 730A along the x axis, the length of the metal plane 730B along the z axis, the length of the metal plane 730C along the x axis and the length of the metal plane 730D along the z axis (i.e., the length of the U shape of the metal plate 730) is a quarter of the first wavelength or a half of the second wavelength. The first wavelength corresponds to the first frequency of the antenna unit 710 and the antenna unit 720, the second wavelength corresponds to the second frequency of the antenna unit 710 and the antenna unit 720. For example, if the first frequency of the antenna unit 710 and the 720 is 2.44 GHz, and the second frequency is 5.5 GHz, the length of the U shape of the metal plate 730 is approximately 3 centimeters.

Figure 8:
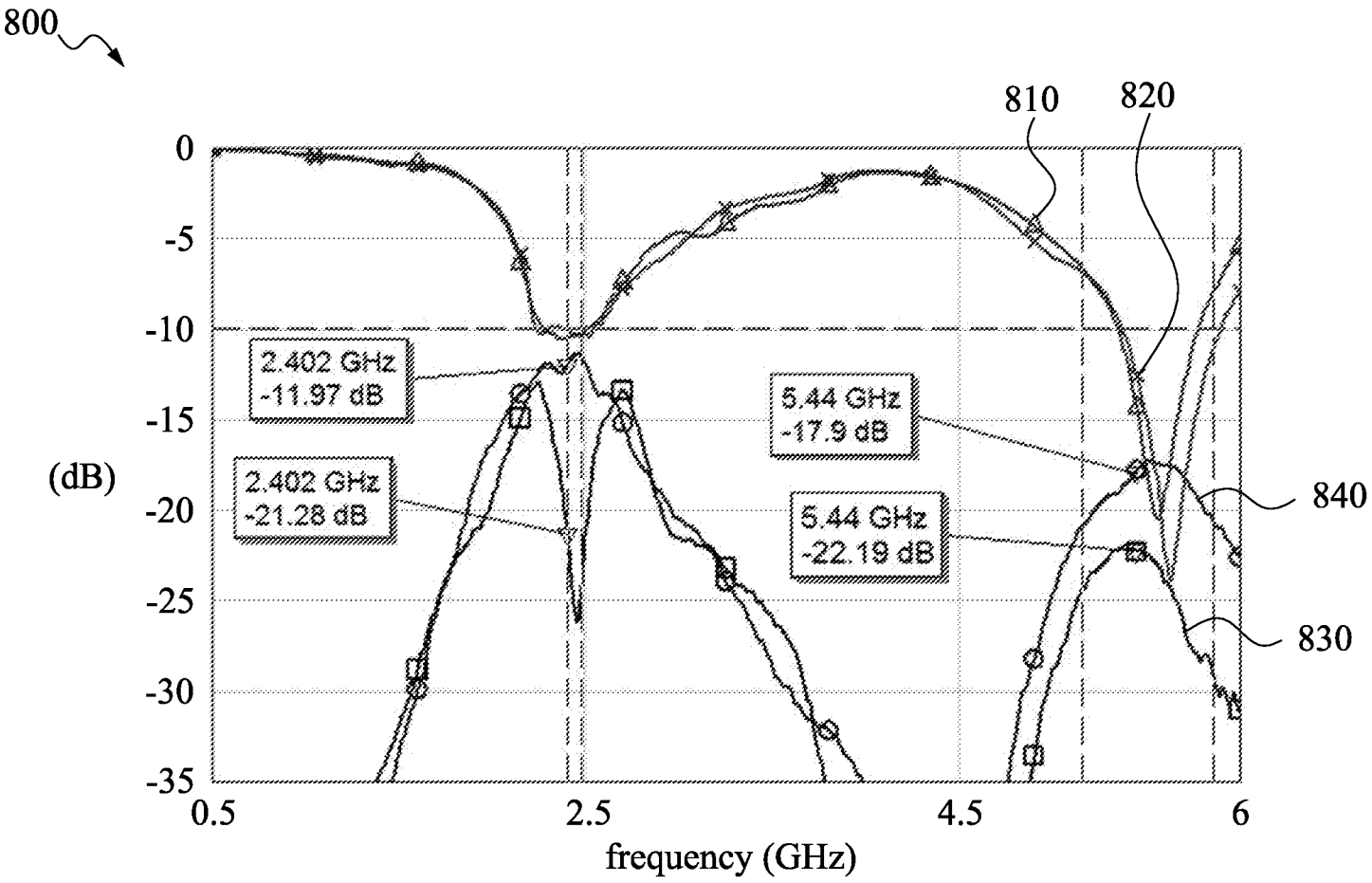
FIG. 8 illustrates a data graph of an antenna device in accordance with some embodiments of the present disclosure.

FIG. 8 illustrates a data graph 800 of an antenna device 700 in accordance with some embodiments of this disclosure. FIG. 8 is an experimental data graph 800, showing the relationship between frequency and reflection loss S11 and the relationship between frequency and isolation S21 measured by a network analyzer. The input impedance adopts a standard of VSWR=2.6:1 or reflection loss S11=−7 dB. The curve 810 is the reflection loss S11 of the antenna unit 720. The curve 820 is the reflection loss S11 of the antenna unit 710. The curve 830 is the isolation S21 between the antenna unit 710 and the antenna unit 720 under the condition that the antenna device 700 adopts the U-shaped metal plate 730. The curve 840 is the isolation S21 between the antenna unit 710 and the antenna unit 720 under the condition that the antenna device 700 does not adopt the U-shaped metal plate 730.

As can be seen from the data graph 800, the antenna device 700 has a minimum reflection loss S11 at the frequencies of 2.44 GHz and 5.5 GHz (−10 dB at 2.44 GHz and −22 dB at 5.5 GHz). As can be seen from the data graph 800, the isolation S21 is obviously better under the condition that the antenna device 700 adopts the U-shaped metal plate 730 (As shown in FIG. 8, the isolation decreases from −12 dB to −21 dB at the frequency of 2.4 GHz. The isolation decreases from −18 dB to −22 dB at the frequency of 5.5 GHz). In some embodiments, if the metal plane 730B and the metal plane 730C are made closer, the isolation at the frequency of 5 GHz can be further decreased, so as to provide a better result.

Figure 9:
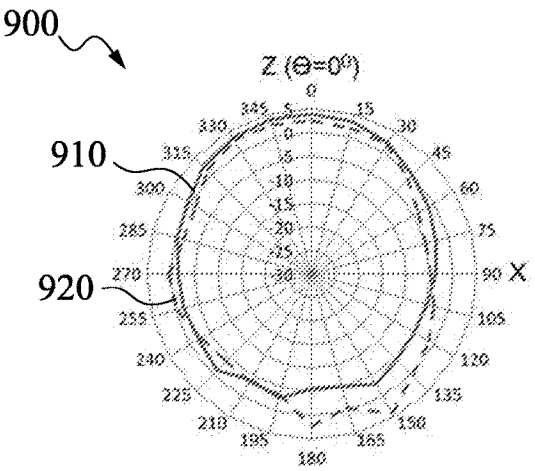
FIG. 9 illustrates a H-plane radiation pattern of an antenna unit in accordance with some embodiments of the present disclosure.

FIG. 9 illustrates the radiation pattern 300 generated by the antenna unit 720 on the H-plane in accordance with some embodiments of this disclosure. FIG. 9 represents the radiation pattern 900 generated by the antenna unit 720 of FIG. 7 at the frequency of 2.44 GHz on the H-plane. The curve 920 represents the gain of the electrical field Eθ+Eϕ generated by the antenna unit 720 on the XZ plane under the condition that the antenna device 700 does not adopt the U-shaped metal plate 730. The curve 910 represents the gain of the electrical field Eθ+Eϕ generated by the antenna unit 720 on the XZ plane under the condition that the antenna device 700 adopts the U-shaped metal plate 730. As can be seen from FIG. 9, the radiation pattern generated by the antenna unit 720 will have an obvious dent at the angle of 60° if the antenna device 700 does not adopt the U-shaped metal plate 730. If the antenna device 700 adopts the metal plate 730, the dent in the radiation pattern can be effectively improved, and better electrical field gain can be obtained at every angle. In other words, through the implementation of the U-shaped metal plate 730 in the antenna device 700 presented in this disclosure, the radiation pattern generated by the antenna unit 720 can be largely improved at the angle of 60°.

Figure 10:
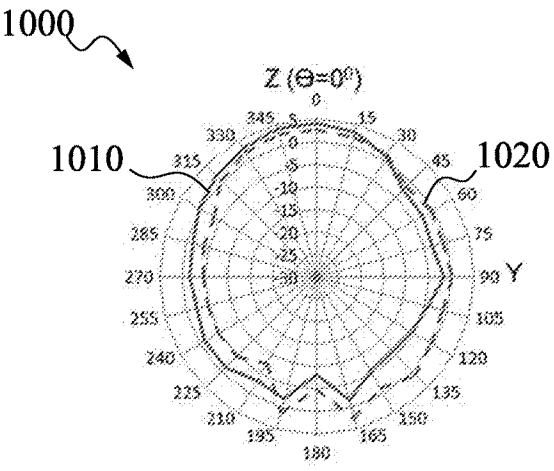
FIG. 10 illustrates a E-plane radiation pattern of an antenna unit in accordance with some embodiments of the present disclosure.

Reference will now be made to FIG. 10. FIG. 10 illustrates the radiation pattern 1000 generated by the antenna unit 720 on the E-plane in accordance with some embodiments of this disclosure. FIG. 10 represents the radiation pattern 1000 generated by the antenna unit 720 of FIG. 7 at the frequency of 2.44 GHz on the E-plane. The curve 1020 represents the gain of the electrical field Eθ+Eϕ generated by the antenna unit 720 on the YZ plane under the condition that the antenna device 700 does not adopt the U-shaped metal plate 730. The curve 1010 represents the gain of the electrical field Eθ+Eϕ generated by the antenna unit 720 on the YZ plane under the condition that the antenna device 700 adopts the U-shaped metal plate 730. As can be seen from FIG. 10, the radiation pattern generated by the antenna unit 720 will have an obvious dent at the angle of 300° if the antenna device 700 does not adopt the U-shaped metal plate 730. If the antenna device 700 adopts the metal plate 730, the dent in the radiation pattern can be effectively improved, and better electrical field strength can be obtained at every angle. In other words, through the implementation of the U-shaped metal plate 730 in the antenna device 700 presented in this disclosure, the radiation pattern generated by the antenna unit 720 can be largely improved at the angle of 300°.

On the other hand, as can be seen from the result of the measurement of the 3D radiation pattern, when the antenna unit 720 is operating at the frequency of 2.44 GHz, the maximum value of the gain of the antenna unit 720 is 3.9 dB, and the antenna efficiency is 72.1%.

Figure 11:
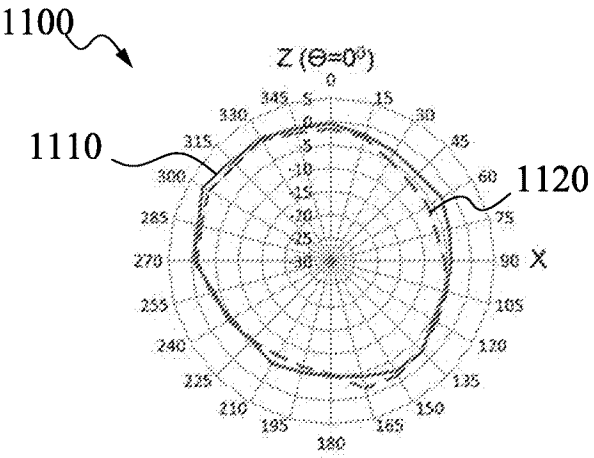
FIG. 11 illustrates a H-plane radiation pattern of an antenna unit in accordance with some embodiments of the present disclosure.

FIG. 11 illustrates the radiation pattern 1100 generated by the antenna unit 720 on the H-plane in accordance with some embodiments of this disclosure. FIG. 11 represents the radiation pattern 1100 generated by the antenna unit 720 of FIG. 7 at the frequency of 5.5 GHz on the H-plane. The curve 1120 represents the gain of the electrical field Eθ+Eϕ generated by the antenna unit 720 on the XZ plane under the condition that the antenna device 700 does not adopt the U-shaped metal plate 730. The curve 1110 represents the gain of the electrical field Eθ+Eϕ generated by the antenna unit 720 on the XZ plane under the condition that the antenna device 700 adopts the U-shaped metal plate 730. As can be seen from FIG. 11, the radiation pattern generated by the antenna unit 720 will have an obvious dent at the angle of 60° if the antenna device 700 does not adopt the U-shaped metal plate 730. If the antenna device 700 adopts the metal plate 730, the dent in the radiation pattern can be effectively improved, and better electrical field strength can be obtained at every angle. In other words, through the implementation of the U-shaped metal plate 730 in the antenna device 700 presented in this disclosure, the radiation pattern generated by the antenna unit 720 can be largely improved at the angle of 60°.

Figure 12:
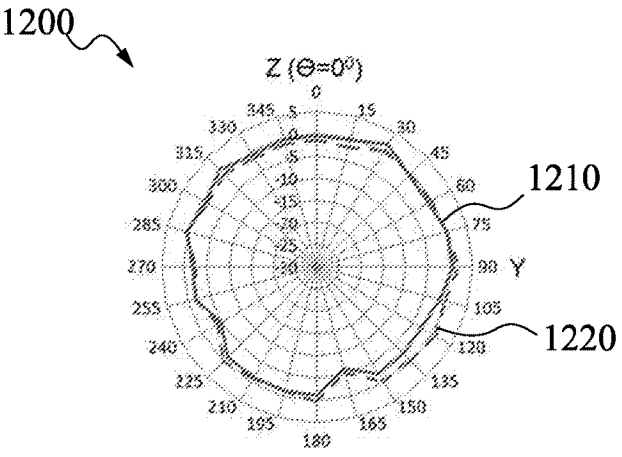
FIG. 12 illustrates a E-plane radiation pattern of an antenna unit in accordance with some embodiments of the present disclosure.

FIG. 12 illustrates the radiation pattern 1200 generated by the antenna unit 720 on the E-plane in accordance with some embodiments of this disclosure. FIG. 12 represents the radiation pattern 1200 generated by the antenna unit 720 of FIG. 7 at the frequency of 5.5 GHz on the E-plane. The curve 1220 represents the gain of the electrical field Eθ+Eϕ generated by the antenna unit 720 on the YZ plane under the condition that the antenna device 700 does not adopt the U-shaped metal plate 730. The curve 1210 represents the gain of the electrical field Eθ+Eϕ generated by the antenna unit 720 on the YZ plane under the condition that the antenna device 700 adopts the U-shaped metal plate 730. As can be seen from FIG. 12, the radiation pattern generated by the antenna unit 720 will have an obvious dent at the angle of 30° if the antenna device 700 does not adopt the U-shaped metal plate 730. If the antenna device 700 adopts the metal plate 730, the dent in the radiation pattern can be effectively improved, and better electrical field strength can be obtained at every angle. In other words, through the implementation of the U-shaped metal plate 730 in the antenna device 700 presented in this disclosure, the radiation pattern generated by the antenna unit 720 can be largely improved at the angle of 30°.

On the other hand, as can be seen from the result of the measurement of the 3D radiation pattern, when the antenna unit 720 is operating at the frequency of 5.5 GHz, the maximum value of the gain of the antenna unit 720 is 3.6 dB, and the antenna efficiency is 73.1%.

Figure 13:
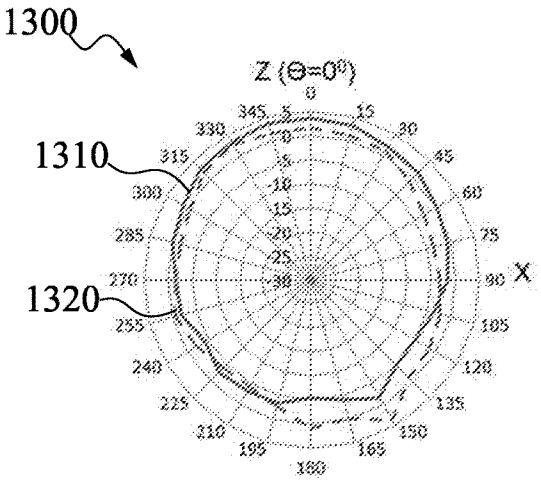
FIG. 13 illustrates a E-plane radiation pattern of an antenna unit in accordance with some embodiments of the present disclosure.

FIG. 13 illustrates the radiation pattern 1300 generated by the antenna unit 710 on the H-plane in accordance with some embodiments of this disclosure. FIG. 13 represents the radiation pattern 1300 generated by the antenna unit 710 of FIG. 7 at the frequency of 2.44 GHz on the H-plane. The curve 1320 represents the gain of the electrical field Eθ+Eϕ generated by the antenna unit 710 on the XZ plane under the condition that the antenna device 700 does not adopt the U-shaped metal plate 730. The curve 1310 represents the gain of the electrical field Eθ+Eϕ generated by the antenna unit 710 on the XZ plane under the condition that the antenna device 700 adopts the U-shaped metal plate 730. As can be seen from FIG. 13, the radiation pattern generated by the antenna unit 710 will have an obvious dent at the angle of 60° if the antenna device 700 does not adopt the U-shaped metal plate 730. If the antenna device 700 adopts the metal plate 730, the dent in the radiation pattern can be effectively improved, and better electrical field strength can be obtained at every angle. In other words, through the implementation of the U-shaped metal plate 730 in the antenna device 700 presented in this disclosure, the radiation pattern generated by the antenna unit 710 can be largely improved at the angle of 60°.

Figure 14:
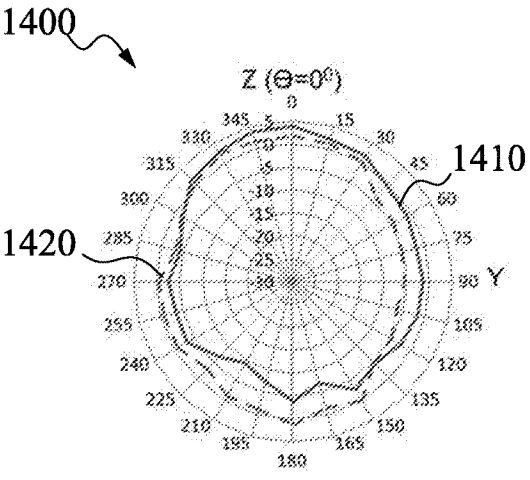
FIG. 14 illustrates a H-plane radiation pattern of an antenna unit in accordance with some embodiments of the present disclosure.

FIG. 14 illustrates the radiation pattern 1400 generated by the antenna unit 710 on the E-plane in accordance with some embodiments of this disclosure. FIG. 14 represents the radiation pattern 1400 generated by the antenna unit 710 of FIG. 7 at the frequency of 2.44 GHz on the E-plane. The curve 1420 represents the gain of the electrical field Eθ+Eϕ generated by the antenna unit 710 on the YZ plane under the condition that the antenna device 700 does not adopt the U-shaped metal plate 730. The curve 1410 represents the gain of the electrical field Eθ+Eϕ generated by the antenna unit 710 on the YZ plane under the condition that the antenna device 700 adopts the U-shaped metal plate 730. As can be seen from FIG. 14, the radiation pattern generated by the antenna unit 710 will have an obvious dent at the angle of 60° if the antenna device 700 does not adopt the U-shaped metal plate 730. If the antenna device 700 adopts the metal plate 730, the dent in the radiation pattern can be effectively improved, and better electrical field gain can be obtained at every angle. In other words, through the implementation of the U-shaped metal plate 730 in the antenna device 700 presented in this disclosure, the radiation pattern generated by the antenna unit 710 can be largely improved at the angle of 60°.

On the other hand, as can be seen from the result of the measurement of the 3D radiation pattern, when the antenna unit 710 is operating at the frequency of 2.44 GHz, the maximum value of the gain of the antenna unit 721 is 3.6 dB, and the antenna efficiency is 71.4%.

Figure 15:
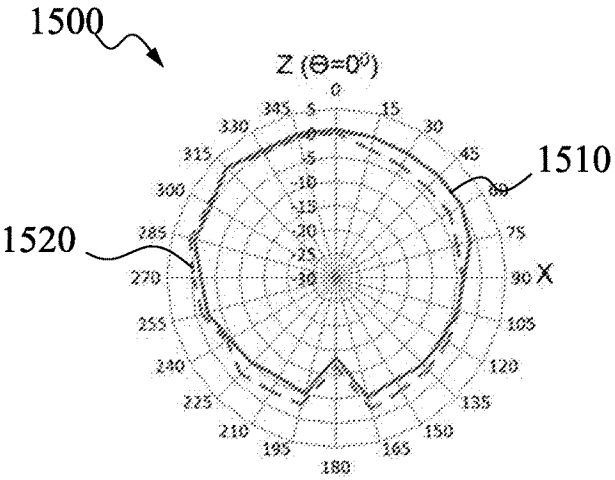
FIG. 15 illustrates a E-plane radiation pattern of an antenna unit in accordance with some embodiments of the present disclosure.

FIG. 15 illustrates the radiation pattern 1500 generated by the antenna unit 710 on the H-plane in accordance with some embodiments of this disclosure. FIG. 15 represents the radiation pattern 1500 generated by the antenna unit 710 of FIG. 7 at the frequency of 2.44 GHz on the H-plane. The curve 1520 represents the gain of the electrical field Eθ+Eϕ generated by the antenna unit 710 on the XZ plane under the condition that the antenna device 700 does not adopt the U-shaped metal plate 730. The curve 1510 represents the gain of the electrical field Eθ+Eϕ generated by the antenna unit 710 on the XZ plane under the condition that the antenna device 700 adopts the U-shaped metal plate 730. As can be seen from FIG. 15, the radiation pattern generated by the antenna unit 710 will have an obvious dent at the angle of 60° if the antenna device 700 does not adopt the U-shaped metal plate 730. If the antenna device 700 adopts the metal plate 730, the dent in the radiation pattern can be effectively improved, and better electrical field gain can be obtained at every angle. In other words, through the implementation of the U-shaped metal plate 730 in the antenna device 700 presented in this disclosure, the radiation pattern generated by the antenna unit 710 can be largely improved at the angle of 60°.

Figure 16:
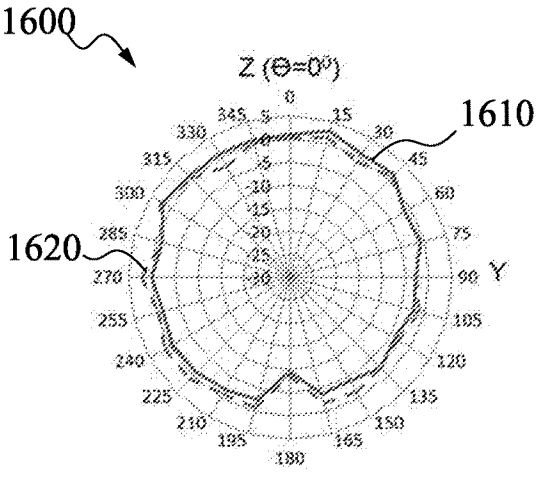
FIG. 16 illustrates a H-plane radiation pattern of an antenna unit in accordance with some embodiments of the present disclosure.

Reference will now be made to FIG. 16. FIG. 16 illustrates the radiation pattern 1600 generated by the antenna unit 710 on the E-plane in accordance with some embodiments of this disclosure. FIG. 16 represents the radiation pattern 1600 generated by the antenna unit 710 of FIG. 7 at the frequency of 5.5 GHz on the E-plane. The curve 1620 represents the gain of the electrical field Eθ+Eϕ generated by the antenna unit 710 on the YZ plane under the condition that the antenna device 700 does not adopt the U-shaped metal plate 730. The curve 1610 represents the gain of the electrical field Eθ+Eϕ generated by the antenna unit 710 on the YZ plane under the condition that the antenna device 700 adopts the U-shaped metal plate 730. As can be seen from FIG. 16, the radiation pattern generated by the antenna unit 710 will have an obvious dent at the angle of 330° if the antenna device 700 does not adopt the U-shaped metal plate 730. If the antenna device 700 adopts the metal plate 730, the dent in the radiation pattern can be effectively improved, and better electrical field strength can be obtained at every angle. In other words, through the implementation of the U-shaped metal plate 730 in the antenna device 700 presented in this disclosure, the radiation pattern generated by the antenna unit 710 can be largely improved at the angle of 330°.

On the other hand, as can be seen from the result of the measurement of the 3D radiation pattern, when the antenna unit 710 is operating at the frequency of 5.5 GHz, the maximum value of the gain of the antenna unit 710 is 2.8 dB, and the antenna efficiency is 75%.

In conclusion, this disclosure adopts the L-shaped metal plate 130 in the antenna device 100 that uses single frequency antenna unit 110 and single frequency antenna unit 120 to conduct wireless signal transmission, so as to obtain an omnidirectional radiation pattern that has no dent. This disclosure also adopts the U-shaped metal plate 730 in the antenna device 700 that uses dual band antenna unit 710 and dual band antenna unit 720 to conduct wireless signal transmission, so as to obtain an omnidirectional radiation pattern that has no dent.

In some embodiments, the antenna device 100 and the antenna device 700 can be integrated into electronic devices that have the function of conducting wireless communication, such as, but not limited to, access points, personal computers, laptops, or any other electronic devices that support MIMO technology and possess communication function are in the scope of this disclosure.

From the embodiments mentioned above, it is known that the embodiments of this disclosure enable two antenna units to generate a radiation pattern that radiates towards the ceiling to conduct wireless communication with wireless access point by disposing two antenna units whose open ends are disposed in correspondence with each other and a specially shaped metal plate (i.e., the L-shaped metal plate 130 or the U-shaped metal plate 730) on the same side.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna device, comprising:

a first ground plane;

a second ground plane connected to the first ground plane;

a first antenna unit disposed on the second ground plane;

a second antenna unit disposed on the second ground plane; and a metal plate connected to the second ground plane and disposed on a position corresponding to the first antenna unit and the second antenna unit, wherein each of the first antenna unit and the second antenna unit is able to cooperate with the first ground plane and the metal plate respectively to generate radiation pattern which is perpendicular to the first ground plane.

2. The antenna device of claim 1, wherein both of the first antenna unit and the second antenna unit are single band antennas, and an open end of the first antenna unit and an open end of the second antenna unit are disposed in correspondence with each other.

3. The antenna device of claim 1, wherein the metal plate is in L shape.

4. The antenna device of claim 1, wherein an angle is formed between the second ground plane and the first ground plane.

5. The antenna device of claim 3, wherein the metal plate comprises a first metal plate and a second metal plate, wherein the first metal plate is disposed perpendicularly to the second metal plate, the second metal plate is disposed perpendicularly to the first metal plate, and the second metal plate extends from the first metal plate towards the first ground plane.

6. The antenna device of claim 5, wherein a sum of a length of the first metal plate in a direction which is perpendicular to the second ground plane and a length of the second metal plate in a direction which is parallel to the second ground plane is a quarter of a wavelength, wherein the wavelength corresponds to an operating frequency of the first antenna unit.

7. The antenna device of claim 1, wherein both of the first antenna unit and the second antenna unit are dual-band antennas, and two open ends of the first antenna unit and two open ends of the second antenna unit are disposed in correspondence with each other, wherein an operating frequency of each of the first antenna unit and the second antenna unit comprises a first frequency and a second frequency, and the first frequency is lower than the second frequency.

8. The antenna device of claim 1, wherein the metal plate is in U shape.

9. The antenna device of claim 8, wherein the metal plate comprises a first metal plane, a second metal plane, a third metal plane, and a fourth metal plane, wherein the first metal plane is disposed perpendicularly to the second ground plane, wherein the second metal plane is disposed perpendicularly to the first metal plane, and extends from the first metal plane in an opposite direction away from the first ground plane, wherein the third metal plane is disposed perpendicularly to the second metal plane, and extends from the second metal plane in an opposite direction away from the second ground plane, and the fourth metal plate is disposed perpendicularly to the third metal plate, and extends from the third metal plate towards the first ground plane.

10. The antenna device of claim 9, wherein a sum of a length of the first metal plane in a direction which is perpendicular to the second ground plane, a length of the second metal plane in a direction which is parallel to the second ground plane, a length of third metal plane in a direction which is perpendicular to the second ground plane, and a length of the fourth metal plane in a direction which is parallel to the second ground plane is a quarter of a first wavelength or half of a second wavelength, wherein the first wavelength corresponds to a first frequency, and the second wavelength corresponds to a second frequency.

11. The antenna device of claim 1, further comprising:

a third antenna unit disposed on the second ground plane, and is configured to generate a radiation pattern which is perpendicular to the second ground plane.

* * * * *